United States Patent [19]

Kreisel et al.

[11] 4,206,018

[45] Jun. 3, 1980

[54] PROCESS FOR THE EXCHANGE OF THERMAL ENERGY

[75] Inventors: Rudolf Kreisel, Nuremberg; Manfred Gress, Berlin; Ludwig Mankut, Altdorf, all of Fed. Rep. of Germany

[73] Assignee: Schering AG, Berlin & Bergkamen, Fed. Rep. of Germany

[21] Appl. No.: 927,992

[22] Filed: Jul. 26, 1978

[30] Foreign Application Priority Data

Jul. 27, 1977 [DE] Fed. Rep. of Germany ..... 2734179

[51] Int. Cl.[2] ..... C21D 21/02

[52] U.S. Cl. ..... 204/29; 204/241

[58] Field of Search ..... 204/241, 29; 165/29

[56] References Cited

U.S. PATENT DOCUMENTS

| | | | |
|---|---|---|---|
| 3,434,948 | 3/1969 | Hooker | 204/241 |
| 3,507,320 | 4/1970 | Russell | 165/29 |
| 3,551,307 | 12/1970 | Gray | 204/241 |
| 3,935,899 | 2/1976 | Jolly | 165/29 |
| 4,037,650 | 7/1977 | Randall | 165/29 |

OTHER PUBLICATIONS

Metal Finishing Guidebook an Directory for 1975, Nathaiel Hall, Editor, Metals and Plastics Publications Inc., pp. 674, 444.

*Primary Examiner*—John H. Mack
*Assistant Examiner*—William Leader
*Attorney, Agent, or Firm*—Michael J. Striker

[57] ABSTRACT

Heat is exchanged between a first bath used for an electrochemical surface treatment and a station which may contain a second, similar bath or a heat-using device. The first bath requires cooling while the station requires heating.

9 Claims, 1 Drawing Figure

PROCESS FOR THE EXCHANGE OF THERMAL ENERGY

BACKGROUND OF THE INVENTION

This invention relates to a process for exchanging heat between a bath requiring cooling and a station which may contain a second bath on some other device requiring heating.

More specifically, the bath requiring cooling is contemplated to be a bath in which metallic and metal-containing workpieces are surface-treated and refined as, for example, in an electrochemical process. In one such electrochemical process, galvanization, for example, a metal or metal alloy is treated by means of an aqueous electrolyte under the influence of a direct current. The speed at which the metal from the electrolyte is deposited on the surface being treated depends on the current density, which is the amperage per unit of surface area of the article being treated.

In order to obtain an optimum treatment, an essentially constant current density must be provided during the electrochemical process. The magnitude of the current density depends on the electrolyte used and on the article to be treated.

In order to obtain a sufficient current, an electrical potential must be applied. The magnitude of the potential depends on the resistance encountered by the current in the electrolyte solution. The electrical energy which must be supplied in order to overcome this resistance is converted to heat.

In some cases the heat thus generated is so great that it exceeds the capacity of the surrounding air to absorb heat at the operating temperature of the bath. In such situations the temperature of the electrolyte solution rises steadily.

In order to obtain an optimum result, however, the operating temperature of the bath must be kept within an allowable range. It is necessary, therefore, to remove the excess heat by some type of cooling mechanism.

The cooling of baths for surface treatments, for example in galvanization baths, is usually accomplished by means of heat exchangers located either inside or outside the bath. The heat is transferred to cool water, which is then discarded as waste water. This waste water might be re-used in the heated baths used to rinse electrochemically treated workpieces, but since the flow of the waste water is intermittent, this possibility is usually disregarded as impractical.

The process for cooling described above is expensive due to the rising costs for fresh water and for waste water removal. In addition, valuable thermal energy is lost.

It is also known to use cold (refrigeration) aggregates, whch raise the heat withdrawn from the electrochemical bath to a still higher level. The heat thus withdrawn is then given off to the atmosphere. This method requires the addition of further electrical energy to operate the refrigeration device. Thus, the rising cost of water is avoided but the rising cost of electrical energy must be paid and the withdrawn thermal energy is still wasted. For these reasons, the cold aggregate method not only requires a large investment but is becoming more and more uneconomical.

SUMMARY OF THE INVENTION

A general object of the present invention is to withdraw the excess thermal energy which is generated in surface treatment baths especially electrochemical treatment baths, and to transfer the thermal energy to a second, similar bath or some other device, which require heating. The temperature level of the second bath or other device will thereby be raised, whereas that of the first bath will be lowered.

According to the invention this object is achieved by transferring the thermal energy and raising the temperature of the bath or other device by means of a heat pump. The evaporator of the heat pump is placed in the first bath out of which thermal energy is to be withdrawn while the condenser of the heat pump is placed in the second bath or other device to which heat is to be applied.

A further characteristic of the invention is that, in order to achieve greater efficiency, the selection of the heat exchange medium and the arrangement of the system are such that the evaporation temperature is not much lower than the operating temperature of the bath in which the evaporator is located. The condensation temperature, on the other hand, is not much higher than the operating temperature of the second bath or other device where the condenser is located. For example, the condenser temperature may efficiently be about ten degrees Celsius above the temperature of the second bath or other device being heated.

With the help of the present invention, it is possible to supply the previously unused thermal energy from the electrochemical first bath to a station containing a second bath or some other device (e.g., a dryer for the surface-treated articles) that requires heat. By comparison with the previous methods described above, therefore, less expenditure of additional energy is necessary for transporting heat and raising the temperature of the bath or device being heated. In addition, thermal energy previously wasted is now saved and put to good use. At the usual working temperatures of electrochemical baths, output numbers of from 3–10 are obtained. This means that with the additionally expended energy for operating the heat pump, a 3–10 fold amount of heat can be supplied to the place where heat is needed.

According to the current state of galvanization techniques, metals such as, for example, chromium, zinc, and nickel require baths that must be cooled more or less extensively depending on the size of the article being treated per unit of time. On the other hand, there are baths in use which must be operated at elevated temperatures and in which no heating from an electrochemical process occurs. Baths which have such constant needs for heat are, for example, chemically operated degreasing baths, and heated rinsing baths. In addition, drying devices in which the object being treated is subjected to a drying operation need a constant source of heat.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a schematic representation of the process according to the present invention.

DESCRIPTION OF A PREFERRED EMBODIMENT

Figure 1:
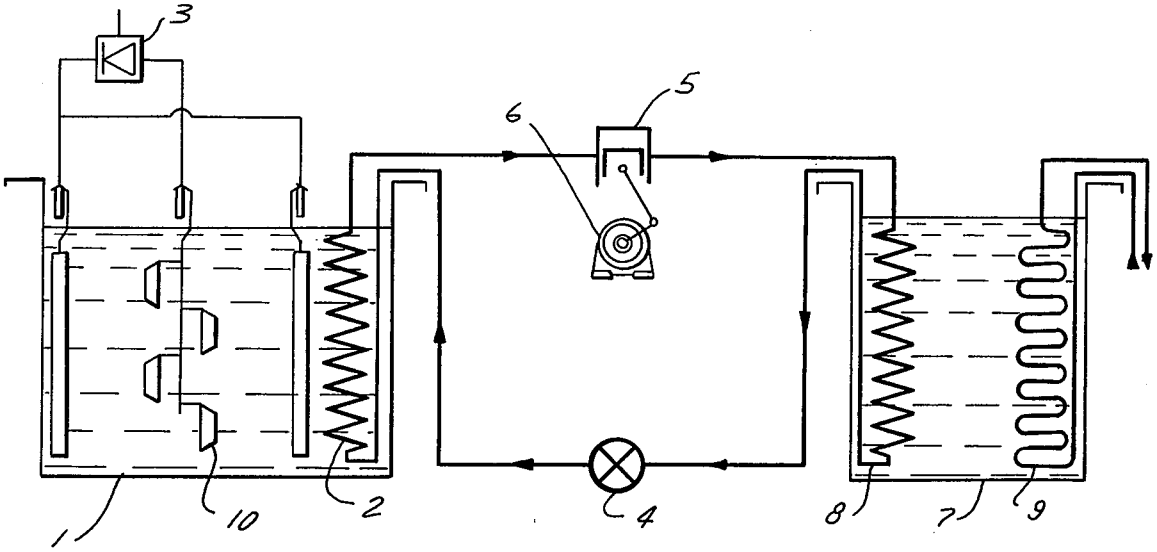

Referring to the drawing a description of a chromium plating bath 1 operated at 38° C. will be given. It is understood that the invention is in no way limited to the treatment of or by any particular metal under any particular set of conditions.

An evaporator 2 is placed in the chromium plating bath 1. During the galvanization process, electrical energy is supplied to the bath by means of a direct current source 3. Part of the electrical energy is converted to heat. In order to keep the temperature of the bath within tolerable limits, the excess heat must be drawn off.

The heat exchange fluid in the heat pump (such heat pumps are well known and no detailed description will therefore be given) flows through a reducing valve 4 and into the evaporator 2. Because of the heating and evaporation that takes place here, heat is removed from the chromium plating bath 1. The vaporized heat exchange fluid is drawn into a compressor 5 which is activated by an electric motor 6. The vapor is compressed whereby its temperature is raised. The energy supplied to the electric motor 6 is, therefore, also transmitted for the most part to the heat exchange fluid in form of thermal energy (i.e., the temperature increases during compression). The vaporized heat exchange fluid next flows to a condenser 8 located (in this embodiment) in a warmed rinsing bath 7. The temperature of the rinsing bath may, in this example, be about 80° C., and is thus lower than the temperature of the flowing vapor which at this point may conveniently be about 90° C.

In the condenser, the vapor is re-liquified so that not only the heat resulting from the temperature decrease of the heat-exchange fluid, but also the heat of vaporization of the same, is made available to the station.

Since it is not always certain that the heat drawn off from the chromium bath 1 is enough to keep the warm rinsing bath 7 at its desired temperature, an auxiliary heater 9 may be placed in the warm rinsing bath. The auxiliary heater 9 may operate by means of electrical energy, steam, or hot water.

In addition, the auxiliary heater 9 serves to heat the warm rinsing bath at the beginning of the operation, before heat is available from the bath 1.

In many cases, the continuous operation of the chromium plating bath provides sufficient heat to fully satisfy the heat requirements of a warm rinsing bath. Such was the case in a working example with the following technical data:

EXAMPLE

Dimensions of the container for a chromium plating bath:

2500 mm wide
650 mm long
1350 mm deep

Dimensions of the container for the warm rinsing bath:

2500 mm wide
550 mm long
1350 mm deep

Surface of the article 10 to be treated: 260 $dm^2$

Galvanization potential in the chromium plating bath: 8 V

Galvanization current in the chromium plating bath: ca. 4000 A

Operating temperature of the chromium plating bath: 38° C.

Operating temperature of the warm rinse bath: 80° C.

Utilization factor (100%=full utilization) of the chromium plating bath: 0.75.

It will be seen that the invention permits significant savings in energy while, at the same time, aiding the operation of the surface treating bath by keeping its temperature within permissible limits. Thus, the invention makes a positive contribution to the goal of conserving energy and reducing operating costs.

While the invention has been illustrated and described as embodied in a process for transferring thermal energy in a galvanic plating process, it is not intended to be limited to the details shown, since various modifications and structural changes may be made without departing in any way from the spirit of the present invention.

Without further analysis, the foregoing will so fully reveal the gist of the present invention that others can, by applying current knowledged, readily adapt it for various applications without omitting features that, from the standpoint of prior art, fairly constitute essential characteristics of the generic or specific aspects of this invention.

We claim:

1. In a method of carrying out electrochemical surface treatments of metallic or metallized workpieces in a bath, the steps of:

immersing an evaporator of a heat pump in said bath;

installing a condenser of the heat pump at a surface treating station;

circulating a heat exchange fluid through said evaporator at one temperature while raising the temperature of the heat exchange fluid therein so as to withdraw thermal energy from said bath; and transferring the heat exchange fluid to the condenser and therein lowering the temperature of the fluid so as to transfer thermal energy from said fluid to said station, whereby thermal energy withdrawn from said bath to maintain the temperature of the latter within permissible limits is transferred to and used for heating said station.

2. A process as recited in claim 1, wherein the temperature of the fluid in the evaporator is close to but below the temperature in the first-mentioned bath and the temperature of the fluid in the condenser is close to but above the temperature of said additional bath.

3. A process as recited in claim 1, wherein the station comprises an additional bath.

4. A process as recited in claim 2, wherein said additional bath is a rinsing bath for rinsing the workpiece.

5. A process as recited in claim 2, wherein said additional bath is a degreasing bath.

6. A process as recited in claim 1, wherein the station includes a device for drying the treated workpiece.

7. A process as recited in claim 1, wherein the temperature of the first-mentioned bath is maintained within said permissible limits so that the resistance of the pathway of electrical current through the electrolyte constituting said first-mentioned bath and, therefore, the current density supplied to the workpiece, remain essentially constant.

8. A process as recited in claim 2, wherein heating of the additional bath is effected in part by means of an auxiliary heater.

9. A process as recited in claim 1, wherein the electrochemical surface treatment is a glavanizing treatment.

* * * * *